United States Patent [19]

Shiomi

[11] Patent Number: 4,791,874

[45] Date of Patent: Dec. 20, 1988

[54] CHAIN STITCH MACHINE

[75] Inventor: Kengo Shiomi, Tokyo, Japan

[73] Assignee: Tokyo Juki Industrial Co., Ltd., Tokyo, Japan

[21] Appl. No.: 931,897

[22] Filed: Nov. 19, 1986

Related U.S. Application Data

[63] Continuation of Ser. No. 696,697, Jan. 31, 1985, abandoned.

[51] Int. Cl.[4] ..... D05B 1/20; D05B 73/12

[52] U.S. Cl. ..... 112/162; 112/260

[58] Field of Search ..... 112/13, 162, 197, 260, 112/269.1, 292

[56] References Cited

U.S. PATENT DOCUMENTS 133,733 12/1872 West ..... 112/260

3,123,033 3/1964 Weigert ..... 112/260 X 4,175,500 11/1979 Radice et al. ..... 112/260 X 4,303,030 12/1981 Palacino et al. ..... 112/260 X

FOREIGN PATENT DOCUMENTS 2301619 10/1976 France ..... 112/162

*Primary Examiner*—Wm. Carter Reynolds

*Attorney, Agent, or Firm*—Tarolli, Sundheim & Covell

[57] ABSTRACT

A needle plate for a device adapted to sew a sequence of idle chain stitches has a guide contiguous to a needle locating opening, which guide is adapted to guide the sequence of idle chain stitches so as to pass through the needle location when the free end of the sequence is grasped by a retainer. With such arrangement, the idle chain stitches are sewn by a sewing thread at least at a position where sewing of a cloth starts and are maintained generally inwardly of a hemstitch seam.

2 Claims, 3 Drawing Sheets

CHAIN STITCH MACHINE

This is a continuation of co-pending application Serial No. 696,697 filed on Jan. 31, 1985, now abandoned.

TECHNICAL FIELD

This invention relates in general to an improved chain stitch machine and, more particularly, to an improvement in a device for sewing a sequence of idle chain stitches, according to which idle chain stitches formed by a chain stitch forming mechanism consisting essentially of a needle and a looper are pulled back onto an upper surface of a needle plate at a foremost position in the direction of cloth feed and sewed into a seam on the lower side of the cloth at the start of the next sewing cycle.

PRIOR ART

In darning or hemstitch sewing with the aid of a chain stitch machine, the conventional practice is to continue machine operation for some time to form a sequence of idle chain stitches with the sewing thread after the sewing together of a cloth has ended and the cloth has stopped being fed to the needle location. The purpose of this operation is to prevent inadvertent extrication of the sewing thread from the needle. After formation of a predetermined length of the sequence of the idle chain stitches, the sewing machine operation is terminated and the cloth thus sewn is cut at its rear edge from the sequence of the idle chain stitches. The sequence of idle chain stitches continuing from the needle location is positioned along a straight path in parallel with the cloth feed direction or at an angle relative thereto in such a manner that the proximate end of sequence is deviated to the right (see FIG. 12). Starting from this condition, the cloth to be sewed next is inserted into the stitching location and the machine is again set into operation to start sewing. The cloth selvage located between a needle location N and the right side surface of a tongue 2 is darned at the hemstitch seam by the operation of the needle, which is reciprocating vertically, and a transversely operated looper.

At this time, an idle chain stitch sequence T extending from the tongue 2 in the direction opposite the cloth feed direction as shown in FIG. 12 is located to the right side of the needle location N so that it is sewed into the embrace of a seam between the lower cloth surface and the hemstitch seam thread transversing the lower cloth surface.

Consequently, when the idle chain stitches sewed into the cloth are pulled for some reason after sewing has been completed, the idle chain stitch sequence T sewed into the hemstitch seam by being embraced between the lower cloth surface and the hemstitch sewing thread is pulled out of the foremost edge of the cloth. This causes fraying of the seam and, hence, results in a sewn product of diminished commercial value.

To eliminate such deficiency, it is known to shift the proximate end of the idle chain stitch sequence T to the left, as shown by the double-dotted chain line in FIG. 12, so that the stitch sequence T is caused to pass through the needle location N during hemstitch sewing. With this method, the idle chain stitches closer to the proximate end of the cloth are sewn by being pierced by the needle so that the stitches will not be extracted even when tension is applied thereto upon termination of sewing. However, the idle chain stitch sequence T located to the left side of the needle location N is moved in the cloth feed direction while remaining in a skewed attitude, as shown by the double-dotted chain line, so that the idle chain stitch slips out of the hemstitch seam without being sewn into the seam. This lowers not only the commercial value of the sewn product but also the sewing efficiency because of the need to perform the operation for cutting the idle chain stitches.

DISCLOSURE OF THE INVENTION

It is an object of the present invention to provide a needle plate for a device adapted to sew idle chain stitches, wherein idle chain stitches of a chain stitch seam can be sewn on the lower surface of a cloth in reliable fashion without emerging from the chain stitch seam.

The present invention resides in an improved needle plate in a sewing device for sewing a sequence of idle chain stitches into a seam on the lower side of a cloth, the device having at least means for securing the device to a frame of a sewing machine, a tongue about which the hemstitch seam is wound, a needle locating opening formed contiguous to the tongue and adapted of being penetrated by a needle, and a retainer for holding a free end of a sequence of idle chain stitches formed by a chain stitch forming mechanism, wherein the needle plate is characterized by having guide means for guiding the idle chain stitches, the guide means being situated in proximity to the needle locating opening and adapted for guiding a sequence of the idle chain stitches in such a manner that the sequence of idle chain stitches is caused to pass through a needle location when the free end of the stitch sequence is grasped by the retainer.

According to a preferred embodiment of the present invention, the guide means is a guide groove formed contiguous to the needle locating opening, the guide groove having an engaging portion formed on an inner edge portion thereof adjacent to the tongue, the engaging portion acting to prevent the idle chain stitch sequence from being raised.

According to another preferred embodiment of the present invention, the guide means is formed in a slider and in proximity to the needle locating opening, the slider being slidably mounted in a direction substantially at right angles to the general direction of the sequence of the idle chain stitches.

PREFERRED EMBODIMENTS OF THE INVENTION

Figure 1:
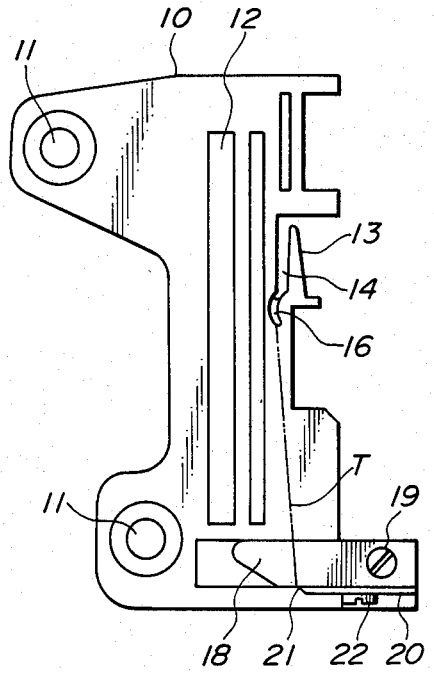
FIG. 1 is a plan view of the needle a throat plate according to the present invention.
Figure 2:
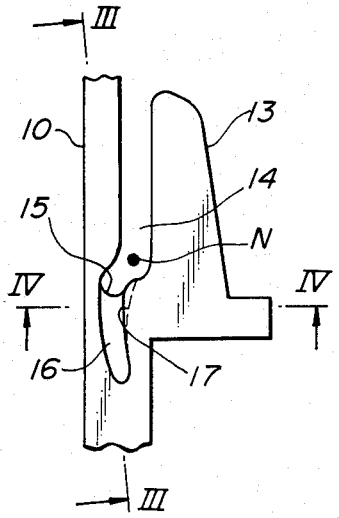
FIG. 2 is an enlarged view of a part of FIG. 1.
Figure 3:
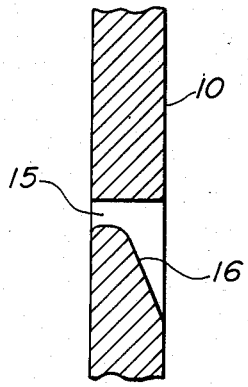
FIG. 3 is a sectional view taken along line III—III of FIG. 2.
Figure 4:
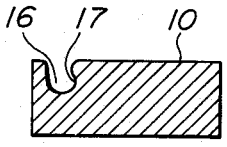
FIG. 4 is a sectional view taken along line IV—IV of FIG. 2.

Referring to FIG. 1, there is shown a needle of throat plate 10 for a hemstitch machine having a pair of mounting holes 11 for securing the needle plate to a machine frame, not shown, a feed pawl opening 12, a tongue 13 about which a hemstitch seam is wound, and a needle locating opening 14. Formed ahead of a needle location N in the opening 14 in the direction of cloth feed is an opening 15 offset to the left in FIGS. 1 and 2. Formed ahead of the opening 15 in the cloth feed direction is an idle chain stitch guide groove 16. In FIGS. 2, 3 and 4, the groove 16 is arcuate in plan view as shown in FIG. 2 and opens to the upper surface of the needle plate 1. The groove 16 becomes narrower in a direction opposite to that of cloth feed as shown in FIG. 3, and a recess or engaging portion 17 is formed in the right side end face or inner edge portion of the guide groove 16, as shown in FIG. 4.

An idle chain stitch retainer 18 has its right side end secured by a screw 19 to the upper surface of the needle plate at a position ahead of the hemstitch sewing area, and has its left end curved slightly above the upper needle plate surface and its lower central surface resiliently engaging the upper surface of the needle plate.

A thread cutting blade 20 is secured by a screw 22 to the forward end face of the needle or throat plate 10 at a position where the left side cutting edge 21 of the blade 20 will contact with and cut through the idle chain stitch sequence T when the stitch sequence T clamped on the lower surface of the chain stitch retainer 18 is brought to the attitude shown in FIG. 1.

OPERATION

Figure 5A:
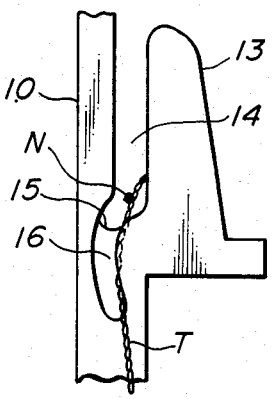
FIGS. 5A, B and C are explanatory views showing the manner in which idle chain stitches are sewn into a seam.
Figure 5B:
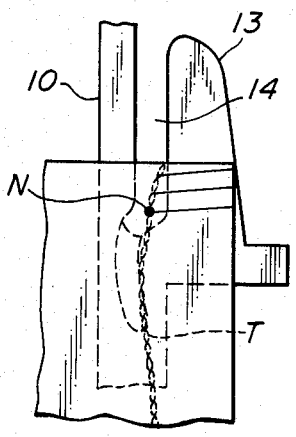
Figure 5C:
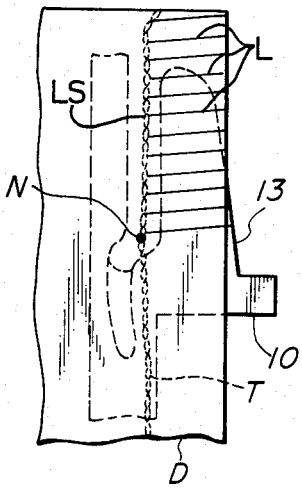

In the operation of the hemstitch machine as well-known in the art, the portion of a cloth D located at the sewing area is resiliently pressed against the upper surface of the needle or throat plate 10 by a cloth retainer, not shown, and is fed in the cloth feed direction or upwardly in FIGS. 1, 2 and 5 by a feed pawl, not shown, that emerges from the pawl feed opening 12 in the needle plate 10 so as to effect movement in four directions. A looper undergoes transverse oscillating movement while the needle performs vertical reciprocating movement at the needle location N. It is through cooperation between the needle and the looper that the hemstitch seam having a linear series of stitches LS and loops L (FIGS. 5C and 6) is produced at the chain stitch seam forming portion around the tongue 13 of the needle plate 10 and the cloth selvage.

When the machine is driven further after the rear edge of the cloth sewn together is passed through the chain stitch seam forming portion, idle chain stitches of the hemstitch seam are formed in continuation with the rear edge of the cloth and starting from the chain stitch seam forming portion. The operation of the machine is halted when the sequence of these idle chain stitches has been formed to a predetermined length.

The cloth retainer, not shown, is then raised and the cloth is pulled back in the direction opposite to the cloth feed direction. The sequence T of the idle chain stitches continuing to the tongue 13 of the chain stitch seam forming portion from the rear edge of the cloth end is caused to enter the recess 17 (FIG. 4) of the idle chain stitch guide groove 16 from the offset opening 15 contiguous to the needle locating opening 14, as shown at A in FIG. 5, and by the double-dotted chain line in FIG. 1. The recess 17 is undercut in the manner shown in FIG. 4, provide a portion which engages the sequence of idle chain stitches to prevent them from being raised out of the groove 16. The proximate end of the idle chain stitch sequence is embraced by the upper surface of the needle plate 10 and the lower surface of the retainer 18 and the sequence T is shifted to the right in the drawing. As a result, the sequence T is brought into contact with and cut by the edge 21 of the thread cutting blade 20, and the cloth is severed. At this time the chain stitch sequence T is as shown in FIGS. 1 and 5A.

Now the cloth is inserted beneath the cloth retainer of the chain stitch seam forming portion of the sewing machine, the cloth retainer then being lowered and the sewing machine being set into operation. As a result, the cloth feed mechanism feeds the cloth forward (upwardly in FIG. 5B), at the same time that the needle is reciprocated vertically and the looper oscillated transversely to start the hemstitch seam along the cloth selvage.

At this time, the idle chain stitch sequence contiguous to the tongue 13 shown in FIG. 5A is connected to the hemstitch seam at the foremost edge of the cloth D and fed forward, while an initial portion of the idle chain stitch sequence T extending from the forward seam of the cloth D to the guide groove 16 intersects the needle location N, as shown in FIG. 5B, so that the needle pierces the initial portion of the chain stitch sequence T to form a seam.

The sewing machine is driven further to feed the cloth D in the cloth feed direction. Since the idle chain stitch sequence T emerging from the groove 16 onto the upper surface of the needle plate 10 in FIG. 5B is sandwiched between the lower surface of the cloth D and the upper surface of the needle plate 10 under the pressure of the cloth retainer, the chain sequence is not introduced into the groove 16 but is arranged linearly on the upper surface of the needle plate 10, as shown in FIG. 5C, while being brought into sliding contact with the upper right end face of the groove 16.

When the sewing machine is driven still further from the condition shown in FIG. 5C to feed the cloth D in the cloth feed direction a second portion of , the idle chain stitch sequence T is shifted to the right side of the needle location N so that the second portion idle chain stitches of the sequence T are not pierced by the needle but are sewn together into the hemstitch seam on the lower surface of the cloth D.

Figure 6:
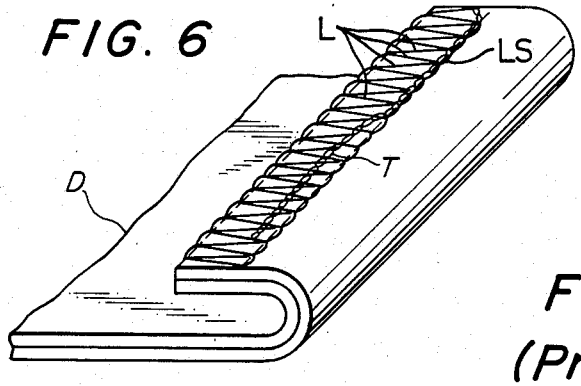
FIG. 6 is a perspective view showing the manner in which sewing of the idle chain stitches into the cloth is terminated.
Figure 12:
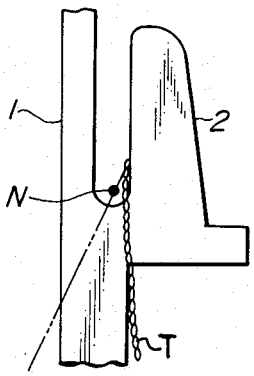
FIG. 12 (Prior Art)
FIG. 12 is a partial plan view of a needle plate showing the condition of idle chain stitches according to the prior art.
Figure 7:
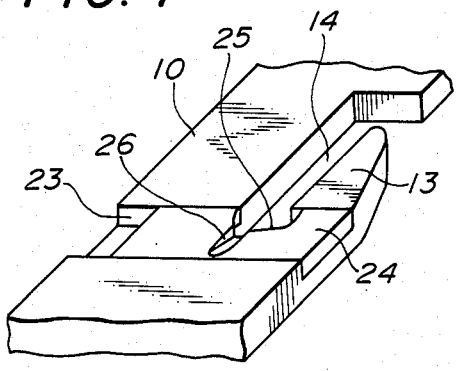
FIG. 7 is a perspective view showing a second embodiment of a needle plate according to the present invention.

The idle chain stitches of the sequence T are sewn on the lower side of the cloth D by being pierced by the vertically reciprocating needle at the foremost end of the cloth where sewing began and are subsequently sewed together into the hemstitch seam on the lower side of the cloth, all as shown in FIG. 6.

FIGS. 7–11 shows a second embodiment of the needle plate of the present invention wherein the idle chain stitch guide groove 26 is slidably disposed for transverse motion with respect to the needle plate 10. In the present embodiment, a transverse slot 23 is formed in the upper surface of the needle plate 10 ahead of the needle location opening 14 when seen in the cloth feed direction. Loosely mounted in the slot 23 is a slider 24 for sliding transversely of the slot between the positions shown in FIGS. 8 and 9.

The slider 24 is formed to include a recess 25 confronting the proximate end of the opening 14 and having a width larger than the width of the opening 14, and with an idle chain stitch guide groove 26 contiguous to the recess 25 and shallower in depth towards the proximate side when seen in the cloth feed direction. The slider 24 is movable manually or by operation of a solenoid, not shown, in such a manner that the idle chain stitch guide groove 26 is shifted into register with the needle location opening 14 shown in FIG. 5A during the first several stitches from the start of sewing (FIG. 9), and is subsequently restored to a position ahead of the needle locating opening 14 (FIG. 8).

Figure 8:
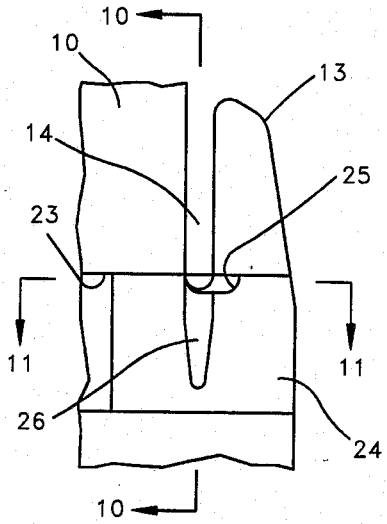
FIG. 8 is a top view of the needle plate of FIG. 7.
Figure 9:
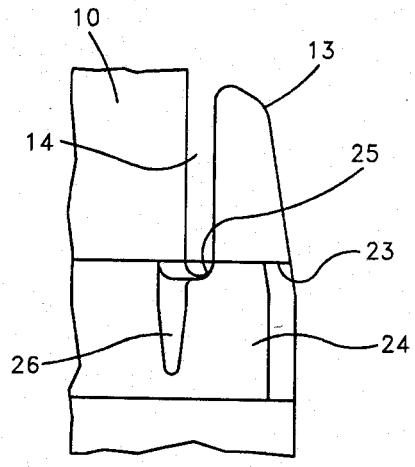
FIG. 9 is a view similar to FIG. 8 but with the needle plate moved to its left limit.
Figure 10:
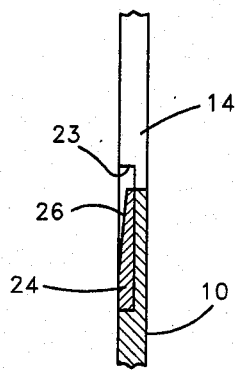
FIG. 10 is a cross sectional view taken along the line X—X in FIG. 8.
Figure 11:
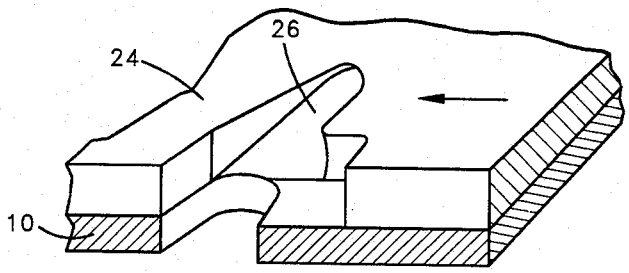
FIG. 11 is a perspective view, taken generally along the line XI—XI in FIG. 8.

In the embodiment shown in FIGS. 7–11, at the beginning of sewing a sequence of idle chain stitches, the slider 24 is temporarily moved from the position shown in FIG. 8 to the position shown in FIG. 9 so that the idle chain stitch guide groove 26 is aligned with the needle location opening 14 (FIG. 5A).

Consequently, during the first several stitches after sewing is started, the needle N pierces through the idle chain stitches so that they are securely sewn into the newly formed seam. Then, the slider 24 returns to the position shown in FIG. 8 from the position shown in FIG. 9, whereupon the needle N does not pierce through the idle chain stitches T anymore. Consequently, the idle chain stitches are only held between the fabric and the sewn seam as shown in FIG. 6.

In both of the above embodiments, the idle chain stitches are pierced by the needle at the start of sewing, after which the stitches are not pierced by the needle but are sewn into the seam. However, the guide groove 16 shown in FIGS. 1 to 5 may be elongated from the opening 15 linearly and in parallel with the cloth feed direction, or the slider 24 shown in FIG. 7 may be fixedly provided so that the idle chain stitch guide groove 26 is in register with the idle chain stitch guide groove 16 shown in FIG. 1, so that the totality of the idle chain stitches of sequence T can be pierced by the needle.

It will be seen from the foregoing that the present invention provides a device for sewing the idle chain stitches formed by the chain stitch forming mechanism into a seam on the lower side of the cloth, wherein there is provided a guide groove by means of which a sequence of the idle chain stitches extending from the seam of the foremost cloth selvage to the proximate side of the cloth is guided to a position intersecting the vertical travel path of the needle. This arrangement of the present invention has a number of advantages which will now be described.

At least a certain number of idle chain stitches contiguous to the foremost cloth selvage and corresponding to the start of sewing are sewn by being pierced by the needle. Therefore, even if the chain stitches are snagged by a foreign object or pulled by the user's finger, the stitches will not be extracted or caused to project from the seam or the cloth selvage. In addition, the sequence T of the idle chain stitches is sewn into the hemstitch seam on the lower side of the cloth between the needle position and the cloth selvage as shown in FIG. 6 or is sewn by being pierced by the needle. As a result, the idle chain stitches will not project from the hemstitch seam.

Accordingly, the commercial value of the sewn product is improved, while the manual operation for cutting a sequence of chain stitches projecting from the hemstitch seam with hand scissors may be dispensed with, thus resulting in enhanced sewing efficiency.

What is claimed is:

1. In a device adapted to be secured to the frame of a sewing machine for use in sewing a sequence of idle chain stitches into a seal on the lower side of a cloth, the device includes a throat plate having a needle locating opening through which a needle is extendible and a retainer for holding a free end of the sequence of idle chain stitches, the throat plate being characterized by having guide means for guiding the idle chain stitches, said guide means being adjacent to said needle locating opening and adapted to guide the sequence of the idle chain stitches in such a manner that the sequence of idle chain stitches is penetrated by the needle sewing a seam when the sequence of idle chain stitches is engaged by said retainer during operation of a sewing machine, said guide means comprising a guide groove formed adjacent to the needle locating opening, said guide groove having surface means defining an engaging portion formed on an inner edge portion thereof, said engaging portion preventing the sequence of idle chain stitches from being moved vertically from said guide groove.

2. An apparatus for use in stitching an initial portion of a sequence of idle chain stitches into a hemstitch seam and retaining a second portion of the sequence of idle chain stitches between the hemstitch seam and a side of the cloth, said apparatus comprising needle means for forming the sequence of idle chain stitches and for sewing a hemstitch seam in which a linear series of stitches penetrate the cloth and in which the seam extends around on edge of the cloth, a throat plate having an opening through which said needle means is repetitively extendible to form the linear series of stitches which penetrate the cloth, and guide means on said throat plate for positioning the initial portion of the sequence of idle chain stitches in alignment with a linear series of locations were the linear series of stitches penetrate the cloth during the sewing of a first portion of the hemstitch seam and for positioning the second portion of the sequence of idle chain stitches between locations where the linear series of stitches penetrate the cloth and the edge of the cloth during the sewing of a second portion of the hemstitch seam, said needle means being operable to penetrate the initial portion of the sequence of idle chain stitches at the locations where the linear series of stitches penetrate the cloth during the sewing of the first portion of the hemstitch seam, said guide means comprising a guide groove formed adjacent to the opening in said throat plate, said guide groove having surface means defining an engaging portion formed on an inner edge portion thereof, said engaging portion blocking movement of the sequence of idle chain stitches vertically from said guide groove.

* * * * *

UNITED STATES PATENT AND TRADEMARK OFFICE

CERTIFICATE OF CORRECTION

PATENT NO. : 4,791,874

DATED : December 20, 1988

INVENTOR(S) : Kengo Shiomi

It is certified that error appears in the above-identified patent and that said Letters Patent is hereby corrected as shown below:

Column 6, line 13, change "seal" to -- seam --.

Signed and Sealed this

Twenty-fifth Day of July, 1989

*Attest:*

DONALD J. QUIGG

*Attesting Officer*

*Commissioner of Patents and Trademarks*